US012163395B2

(12) United States Patent
Chomatas

(10) Patent No.: US 12,163,395 B2
(45) Date of Patent: Dec. 10, 2024

(54) METHOD AND APPARATUS FOR A WELL VIBRATOR TOOL

(71) Applicant: SAUDI ARABIAN OIL COMPANY, Dhahran (SA)

(72) Inventor: Apostolos Chomatas, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 8 days.

(21) Appl. No.: 17/966,345

(22) Filed: Oct. 14, 2022

(65) Prior Publication Data

US 2024/0125190 A1 Apr. 18, 2024

(51) Int. Cl.
*E21B 31/00* (2006.01)
*E21B 47/18* (2012.01)

(52) U.S. Cl.
CPC ..... *E21B 31/005* (2013.01); *E21B 47/18* (2013.01)

(58) Field of Classification Search
CPC ..... E21B 31/005; E21B 47/18
See application file for complete search history.

(56) References Cited

U.S. PATENT DOCUMENTS 3,155,163 A * 11/1964 Bodine, Jr. ..... E21B 7/24 166/301
6,845,818 B2 1/2005 Tutuncu et al.
7,066,250 B2 6/2006 Webb
8,424,605 B1 4/2013 Schultz et al.
11,066,903 B2 7/2021 MacDougall et al.
2009/0266612 A1* 10/2009 Allahar ..... E21B 7/24 175/55
2015/0159452 A1* 6/2015 Miller ..... E21B 7/24 166/384
2017/0292328 A1* 10/2017 Swinford ..... E21B 31/18
2020/0173258 A1* 6/2020 MacDougall ..... E21B 47/092

OTHER PUBLICATIONS

O. Gonzalez et al., "The Extraction of Mud-Stuck Tubulars Using Vibratory Resonant Techniques", SPE International 109530, pp. 1-8 (8 pages).
C. E. Cooke Jr. et al., "Primary Cementing Improvement by Casing Vibration During Cement Curing Time", SPE Production Engineering, August, pp. 339-345 (7 pages).
O. J. Gonzalez, "Retrieving Stuck Liners, Tubing, Casing, and Drillpipe with Vibratory Resonant Techniques", SPE Drilling Engineering, Sep. 1987, pp. 245-256 (12 pages).

* cited by examiner

*Primary Examiner* — Taras P Bemko
(74) *Attorney, Agent, or Firm* — Osha Bergman Watanabe & Burton LLP

(57) ABSTRACT

A downhole vibration tool includes a head unit, a housing, a power system, a control system, at least one electrical motor, an engagement system, at least one vibration module, and at least one tractor section. The head unit is configured to attach to a conveyance system in a wellbore. The housing is configured to receive the cable head and house the power system, the control system, the at least one electrical motor, the engagement system, the vibration module and the at least one tractor section. The engagement system is configured to extend outward from the housing and contact the wellbore.

6 Claims, 6 Drawing Sheets

METHOD AND APPARATUS FOR A WELL VIBRATOR TOOL

BACKGROUND

In the oil and gas industry many activities are carried out in a wellbore. Some of these activities can result it equipment such as drill pipe, casing, or tubing to become stuck in the wellbore. When objects become stuck in the wellbore issues of cost and safety may arise. For instance, if the object cannot be removed the wellbore, the wellbore may need to sidetracked to a less optimal location which may lead to greater capital costs for the well and more exposure to drilling or completion risks.

When casing is set in the wellbore, it is cemented in place to ensure wellbore integrity and to ensure undesired subsurface fluids to not enter or leak from the wellbore or to the surface. During the cementing process, channels and voids can develop in the cement, which may permit fluids to migrate through undesired pathways or damage the well.

It is desirable to have tools and processes available that can be used in a variety of activities, such as stuck object retrieval and cementing, that enable safe and efficient operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments a downhole vibration tool in a wellbore and methods of use of the downhole vibration tool. The downhole vibration tool includes a head unit, a housing, a power system, a control system, at least one electrical motor, an engagement system, at least one vibration module, and at least one tractor section. The head unit is configured to attach to a conveyance system in a wellbore. The housing is configured to receive the cable head and house the power system, the control system, the at least one electrical motor, the engagement system, the vibration module and the at least one tractor section. The engagement system is configured to extend outward from the housing and contact the wellbore.

In accordance with one or more embodiments, a stuck object retrieval method includes conveying a downhole vibration tool to a point of interest in a wellbore, deploying an engagement system to anchor the downhole vibration tool and determine a position and orientation of the downhole vibration tool relative to the wellbore, and activating the downhole vibration tool, having at least one vibration module, according to a configuration. The downhole vibration tool is activated using the following steps that may be performed iteratively and repetitively: measuring data using a sensor module, determining a position and an orientation change of the downhole vibration tool relative to the wellbore, adjusting an operational parameter of the vibration module, vibrating the downhole vibration tool continuously or in pulses, exerting a pulling or pushing force through a wireline or a tractor section until the stuck object is freed. The method finally includes retrieving the stuck object engaged with the downhole vibration tool.

In accordance with one or more embodiments, a cementing method includes conveying a downhole vibration tool to a depth in a wellbore after placement of a cement and deploying an engagement system to anchor the downhole vibration tool to establish a mechanical connection between the downhole vibration tool and a cemented casing section. The following steps may be performed iteratively and repetitively: activating at least one vibration module, measuring a sensor data using a sensor module, adjusting an operational parameter of the vibration module, vibrating the downhole vibration tool continuously or in pulses, determining a cement job quality based, at least in part, on the sensor data, moving the downhole vibration tool up hole, and determining a job completeness based, at least in part, on a position of the downhole vibration tool in the wellbore relative to the cement.

Other aspects and advantages of the claimed subject matter will be apparent from the following description and the appended claims.

DETAILED DESCRIPTION

Figure 1A:
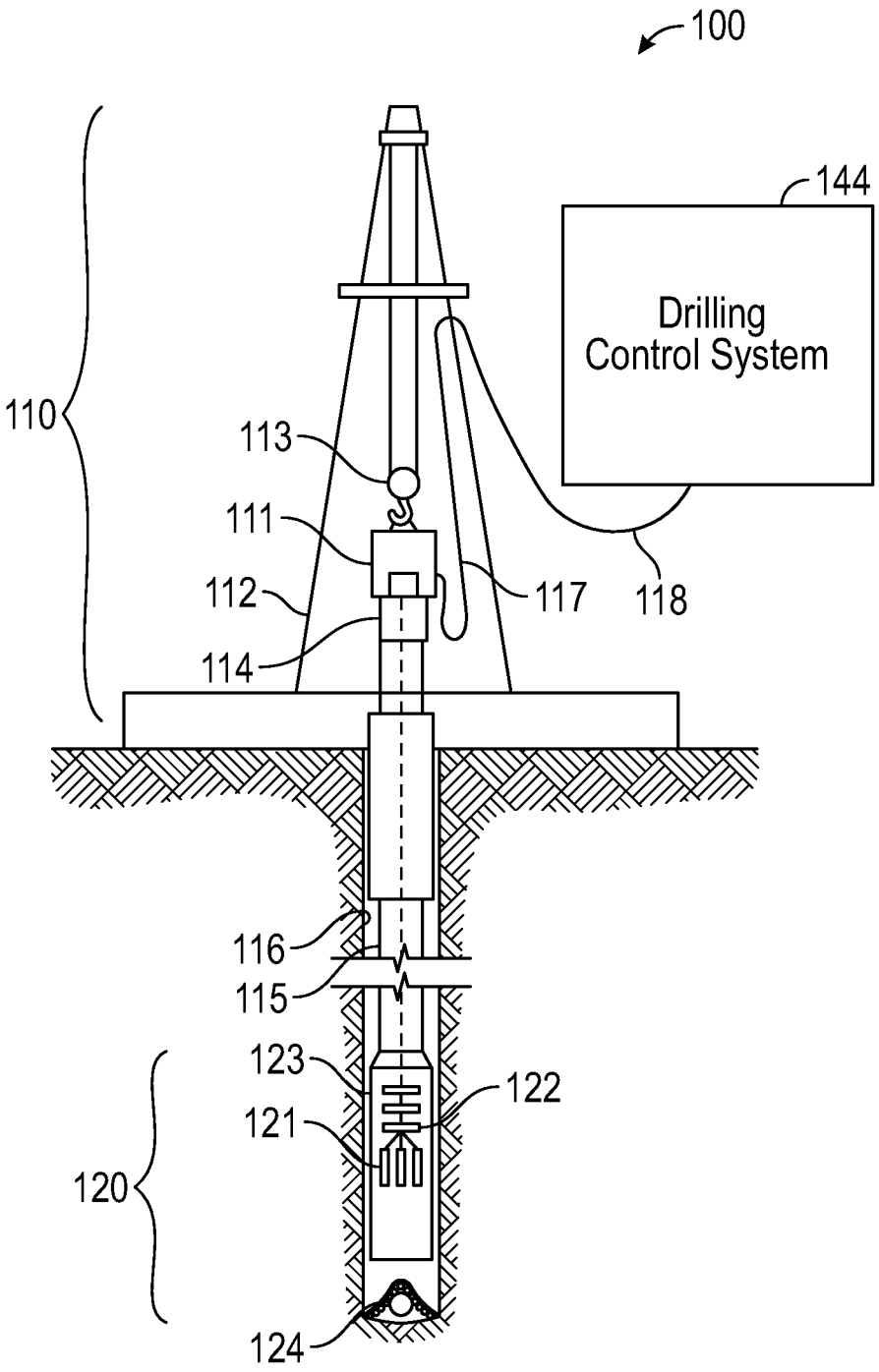
FIG. 1A shows a drawing of a drilling system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-5 any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a model parameter" includes reference to one or more of such parameters.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

Embodiments disclosed describe a downhole vibration tool and two methods of use. In accordance with one or more embodiments, one method describes using the downhole vibration tool for retrieving stuck objects from a wellbore. Herein, the term wellbore, may refer to the open hole section of a well or the inside of downhole pipe, such as a casing string. In accordance with one or more embodiments, the second method describes using the downhole vibration tool in a cement job assurance process. One of ordinary skill in the art will appreciate that the tool components and methodologies described may be selected and implemented for other applications.

Figure 1B:
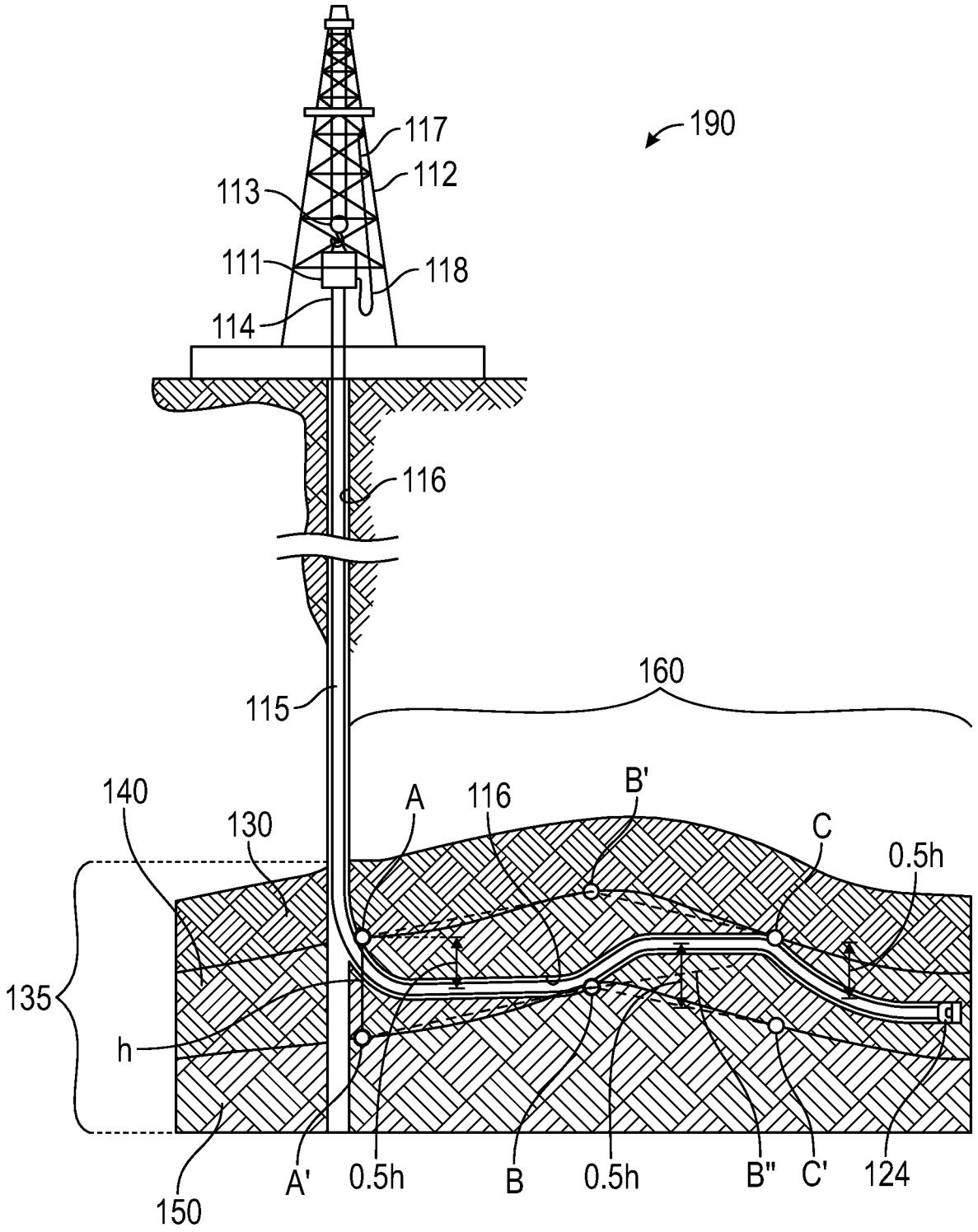
FIG. 1B shows a drawing of a drilling system in accordance with one or more embodiments.

FIGS. 1A and 1B illustrate drilling systems in accordance with one or more embodiments. As shown in FIG. 1A, a drilling system (100) may include a top drive drill rig (110) arranged around the setup of a drill bit logging tool (120). A top drive drill rig (110) may include a top drive (111) that may be suspended in a derrick (112) by a travelling block (113). In the center of the top drive (111), a drive shaft (114) may be coupled to a top pipe of a drill string (115), for example, by threads. The top drive (111) may rotate the drive shaft (114), so that the drill string (115) and a drill bit logging tool (120) cut the rock at the bottom of a wellbore (116). A power cable (117) supplying electric power to the top drive (111) may be protected inside one or more service loops (118) coupled to a drilling control system (144). As such, drilling mud may be pumped into the wellbore (116) through a mud line, the drive shaft (114), and/or the drill string (115).

Moreover, when completing a well, casing may be inserted into the wellbore (116). The sides of the wellbore (116) may require support, and thus the casing may be used for supporting the sides of the wellbore (116). As such, a space between the casing and the untreated sides of the wellbore (116) may be cemented to hold the casing in place. The cement may be forced through a lower end of the casing and into an annulus between the casing and a wall of the wellbore (116). More specifically, a cementing plug may be used for pushing the cement from the casing. For example, the cementing plug may be a rubber plug used to separate cement slurry from other fluids, reducing contamination and maintaining predictable slurry performance. A displacement fluid, such as water, or an appropriately weighted drilling mud, may be pumped into the casing above the cementing plug. This displacement fluid may be pressurized fluid that serves to urge the cementing plug downward through the casing to extrude the cement from the casing outlet and back up into the annulus.

As further shown in FIG. 1A, sensors (121) may be included in a sensor assembly (123), which is positioned adjacent to a drill bit (124) and coupled to the drill string (115). Sensors (121) may also be coupled to a processor assembly (123) that includes a processor, memory, and an analog-to-digital converter (122) for processing sensor measurements. For example, the sensors (121) may include acoustic sensors, such as accelerometers, measurement microphones, contact microphones, and hydrophones. Likewise, the sensors (121) may include other types of sensors, such as transmitters and receivers to measure resistivity, gamma ray detectors, etc. The sensors (121) may include hardware and/or software for generating different types of well logs (such as acoustic logs or density logs) that may provide well data about a wellbore (116), including porosity of wellbore (116) sections, gas saturation, bed boundaries in a geologic formation, fractures in the wellbore (116) or completion cement, and many other pieces of information about a formation. If such well data is acquired during drilling operations (i.e., logging-while-drilling), then the information may be used to make adjustments to drilling operations in real-time. Such adjustments may include rate of penetration (ROP), drilling direction, altering mud weight, and many others drilling parameters.

In some embodiments, acoustic sensors may be installed in a drilling fluid circulation system of a drilling system (100) to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, casing shoe positioning, etc.

The drilling control system (144) may be coupled to the sensor assembly (123) in order to perform various program functions for up-down steering and left-right steering of the drill bit (124) through the wellbore (116). More specifically, the drilling control system (144) may include hardware and/or software with functionality for geosteering a drill bit through a formation in a lateral well using sensor signals, such as drilling acoustic signals or resistivity measurements. For example, the formation may be a reservoir region, such as a pay zone, bed rock, or cap rock.

Turning to geosteering, geosteering may be used to position the drill bit (124) or drill string (115) relative to a boundary between different subsurface layers (e.g., overlying, underlying, and lateral layers of a pay zone) during drilling operations. In particular, measuring rock properties during drilling may provide the drilling system (100) with the ability to steer the drill bit (124) in the direction of desired hydrocarbon concentrations. As such, a geosteering system may use various sensors located inside or adjacent to the drilling string (115) to determine different rock formations within a path of the wellbore (116). In some geosteering systems, drilling tools may use resistivity or acoustic measurements to guide the drill bit (124) during horizontal or lateral drilling.

Turning to FIG. 1B, FIG. 1B illustrates some embodiments for steering a drill bit through a lateral pay zone using a geosteering system (190). As shown in FIG. 1B, the geosteering system (190) may include the drilling system (100) from FIG. 1A. In particular, the geosteering system (190) may include functionality for monitoring various sensor signatures (e.g., an acoustic signature from acoustic sensors) that gradually or suddenly change as a well path traverses a cap rock (130), a pay zone (140), and a bed rock (150). Because of the sudden change in lithology between the cap rock (130) and the pay zone (140), for example, a sensor signature of the pay zone (140) may be different from the sensor signature of the cap rock (130). When the drill bit (124) drills out of the pay zone (140) into the cap rock (130), a detected amplitude spectrum of a particular sensor type may change suddenly between the two distinct sensor signatures. In contrast, when drilling from the pay zone (140) downward into the bed rock (150), the detected amplitude spectrum may gradually change.

During the lateral drilling of the wellbore (116), preliminary upper and lower boundaries of a formation layer's thickness may be derived from a geophysical survey and/or an offset well obtained before drilling the wellbore (116). If a vertical section (135) of the well is drilled, the actual upper and lower boundaries of a formation layer (i.e., actual pay zone boundaries (A, A')) and the pay zone thickness (i.e., A to A') at the vertical section (135) may be determined. Based on this well data, an operator may steer the drill bit (124) through a lateral section (160) of the wellbore (116) in real time. In particular, a logging tool may monitor a detected sensor signature proximate the drill bit (124), where the detected sensor signature may continuously be compared against prior sensor signatures, e.g., of the cap rock (130), pay zone (140), and bed rock (150), respectively. As such, if the detected sensor signature of drilled rock is the same or similar to the sensor signature of the pay zone (140), the drill bit (124) may still be drilling in the pay zone (140). In this scenario, the drill bit (124) may be operated to continue drilling along its current path and at a predetermined distance (0.5*h*) from a boundary of a formation layer. If the detected sensor signature is same as or similar to the prior sensor signatures of the cap rock (130) or the bed rock (150), respectively, then the drilling control system (144) may determine that the drill bit (124) is drilling out of the pay zone (140) and into the upper or lower boundary of the pay zone (140). At this point, the vertical position of the drill bit (124) at this lateral position within the wellbore (116) may be determined and the upper and lower boundaries of the pay zone (140) may be updated, (for example, positions B and C in FIG. 1B). In some embodiments, the vertical position at the opposite boundary may be estimated based on the predetermined thickness of the pay zone (140), such as positions B' and C'.

While FIGS. 1A, and 1B shows various configurations of components, other configurations may be used without departing from the scope of the disclosure. For example, various components in FIGS. 1A, and 1B may be combined to create a single component. As another example, the functionality performed by a single component may be performed by two or more components.

Figure 2:
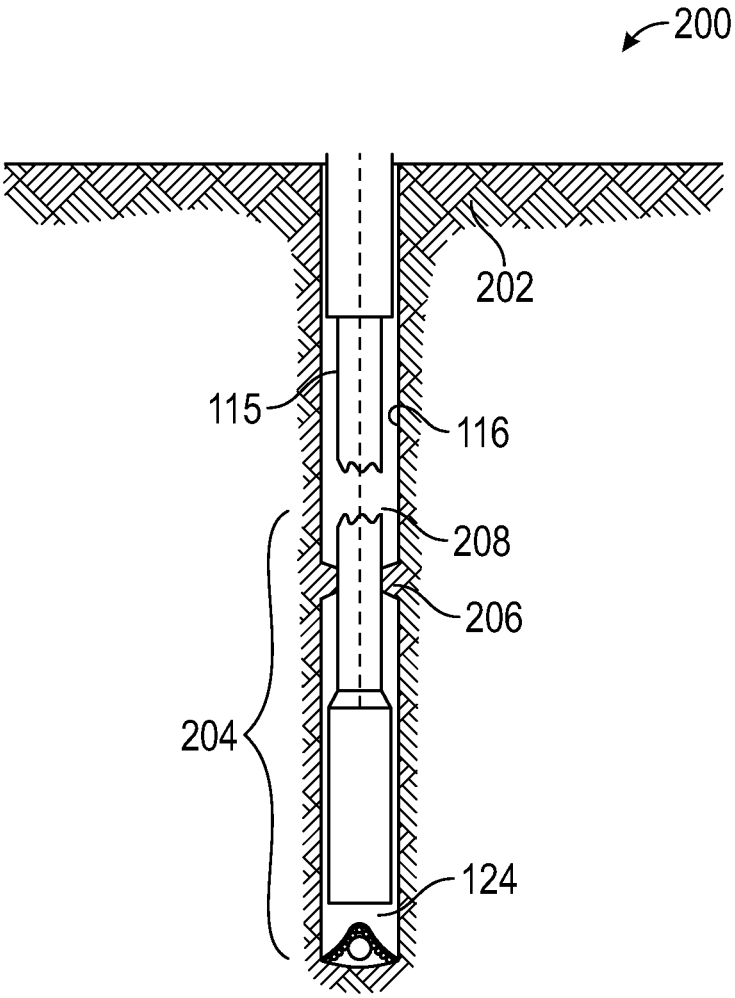
FIG. 2 shows a drawing of a wellbore in accordance with one or more embodiments.

FIG. 2 shows a cross section (200) in which subsurface material (202) through which the wellbore (116) passes has collapsed into the annular space between the wellbore (116) and the drill string (115). The collapsed subsurface material (202) may cause a portion of drill string (115) and all equipment below (for example, the drill bit) to become a stuck object (204) in the wellbore (116). The depth at which the subsurface material (202) causes a drill string (115) (or other downhole equipment) to become stuck may be referred to as a sticking point (206). The drill string, and other equipment above the sticking point (206) may be retrieved from the wellbore (116). The upper part of the stuck object (204) may be referred to as the free end (208) of the stuck object (204).

Although shown as collapsed subsurface material (202) in a vertical hole section (135), one of ordinary skill in the art will recognize that an object may become stuck in a wellbore (116) for a variety of reasons (for example, equipment failure, and various types of differential and mechanical sticking) and in any hole section (vertical, lateral, or deviated). One of ordinary skill in the art may also recognize that, while a drill string (116) is used for illustrative purposes, other objects such as coil tubing, bottom hole assemblies, and logging tools may also become stuck objects (204) in a wellbore (116).

Figure 3:
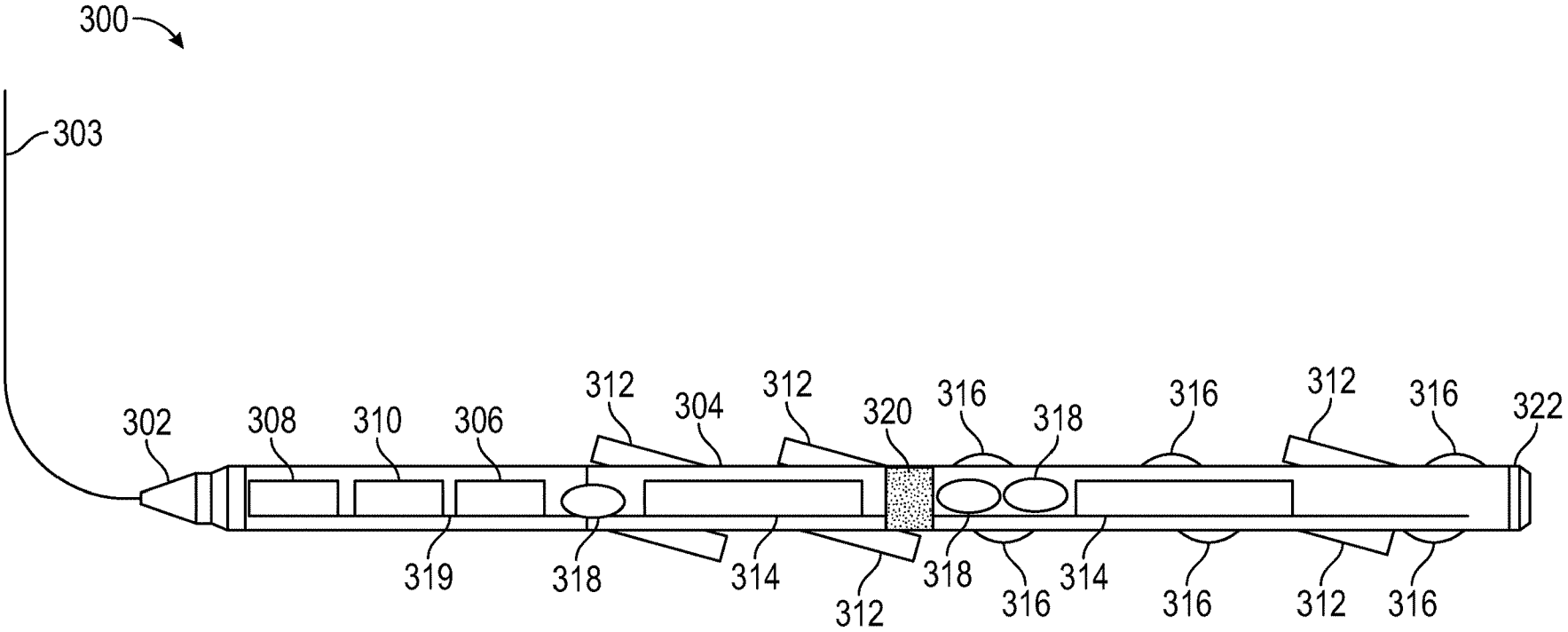
FIG. 3 shows a schematic of an apparatus in accordance with one or more embodiments.

FIG. 3 shows a schematic diagram of a Downhole Vibration Tool (DVT) (300). The DVT (300) is made up of a head unit (302) configured to attach to a conveyance system (303) in a wellbore (116). The conveyance system (303) may be any type of conveyance system known in the art such as wireline, coiled tubing, drill pipe, etc. The head unit (302) may attach to a housing (304) that is configured to house the components of the DVT (300). Disposed within the housing (304) of the DVT (300) may be a power system (306) which is electrically connected to the surface to supply power to all the components of the DVT (300). In one or more embodiments the power system may also include a battery system for one or more of the components of the DVT (300).

The power system (306) may supply power to the control system (308). The control system (308) may include communications equipment configured to communicate with the surface through wired or wireless communication and to the components of the DVT (300). The control system (308) may also include a microprocessor, memory, and input/out devices configured to periodically or continually receive and process data from one or more sensor modules (318). The processed data from the sensor modules (318) may be used to periodically or continually determine and adjust one or more operational parameters of the vibration modules (314), such as operating frequency, power, and vibration orientation.

The control system (308) may also control the number and geometry of the vibration modules activated during an operational period. Further the controls system (308) may also use sensor module (318) data to control the electric motor (310) which may be configured to provide mechanical force for the tractor section (316) and engagement system (312). The sensor module (318) may include a plurality of sensors such as accelerometers, gyroscopic sensors, strain sensors (weight, strain, force, deflection, vibration, torque, pressure, etc.) to measure and monitor the affect of the vibration module (314) in its particular application. The sensor module (318) data may also be configured to determine the orientation and position of the housing (304) (and other DVT (300) components) relative to the wellbore (116).

Electrical wiring (319) is located within the DVT (300) and is used to supply power throughout the DVT (300). In accordance with one or more embodiments, the electrical wiring (319) may be used to supply power from the power section (306) to any other component in the DVT (300). In other embodiments, the electrical wiring (319) may be electrically connected to the conveyance device (303), and power may be transferred to the DVT (300) using power transferred from the surface to the electrical wiring (319), using the conveyance device (303)

Continuing with FIG. 3, as depicted in FIG. 3 an engagement system (312) in one or more embodiments may include several extending arms that may be driven by the electric motor through a tensioning device (such as a rod, screw, or wire reel). The deployment of the engagement system provides mechanical contact between the DVT (300) and the wellbore (116) or the stuck object (204) by applying an outward pressure. The engagement system (312) may also produce a frictional force between the points of contact with the stuck object (204) providing an anchor point(s) for pulling or pushing forces. The pulling or pushing forces may be supplied from the surface uphole or the tractor section (316) downhole. It will be recognized by one of ordinary skill in the art that the engagement system (312) may also be powered and controlled from the surface and the force extending the arms may be supplied by tension in the conveyance.

FIG. 3 also shows that vibration modules (314) may be disposed in multiple sections of the housing (304). The vibration modules may be driven electromechanically, pneumatically, or electromagnetically. The frequency and strength of the vibrations generated may be controlled by controlling the electrical energy to the vibration module (314). The frequency and strength may be varied over wide ranges depending on the geometry and power required to achieve the objective. Further, the number of vibration modules (314) may vary depending on the application for which the tool is being used. For example, only one vibration module may be required if the free end (208) is very near to the sticking point (206). Multiple vibration modules may be used in a synchronous or asynchronous mode to create resonance in the stuck object (204) and may be placed at greater distances from the sticking point (206). Single or multiple vibration modules (314) may also be used in cementing assurance to a vibration at multiple depths simultaneously or in a sequential pattern in the wellbore (116) after the cementation process is complete.

The tractor section (316) may be used to deploy the DVT (300) in wellbore (116) configurations that are not vertical. One or more tractor sections may be deployed in the make up of the DVT (300). The tractor section (316) may be a leading tractor section as it may be the most downhole portion of the tool. The tractor section (316) may rely on an electric motor (310) to provide the mechanical power to drive the tool downhole (or provide pulling power). In one or more embodiments, a leading tractor section (316) may be configured to attach to a fishing tool (not shown) or milling tool (not shown) that may be used as an alternate engagement system (312) with a stuck object (204). The tractor section (316) may also include at least one vibration module (314). In one embodiment, the tractor section (316) may be the only section with a vibration module (314).

In accordance with one or more embodiments, the DVT (300) includes a vibration dampener (320). The vibration dampener (320) may be used to divide the DVT (300) in two separate parts which can vibrate and/or engage the wellbore (116) independently from one another. This allows separate portions of the wellbore (116) to be engaged/vibrated depending on the downhole scenario. In further embodiments, a well intervention drone (322) is connected to the DVT (300). The drone (322) may be connected to the tractor section (316) of the DVT (300) using any means known in the art such as a threaded connection or a welded connection. The drone (322) may be autonomously controlled and may perform a myriad of functions related to deployment in a wellbore (116) and retrieval of a stuck object (204) in the wellbore (116). For example, the drone (322) may be used to connect the DVT (300) to a fishing or milling tool (not pictured), and the drone (322) may be used to control and provide data on a fishing operation that is being performed using the fishing or milling tool. The fishing or milling tool may be any fishing or milling tool known in the art that is used to engage with, clear around, or remove an object from a wellbore (116). For purposes of example only, the fishing or milling tool may be an overshot tool, a mill shoe, a spear, a hook, a magnet, etc. In further embodiments, the drone (322) may be used to directly engage with a stuck object (204) in the wellbore (116).

Figure 4:
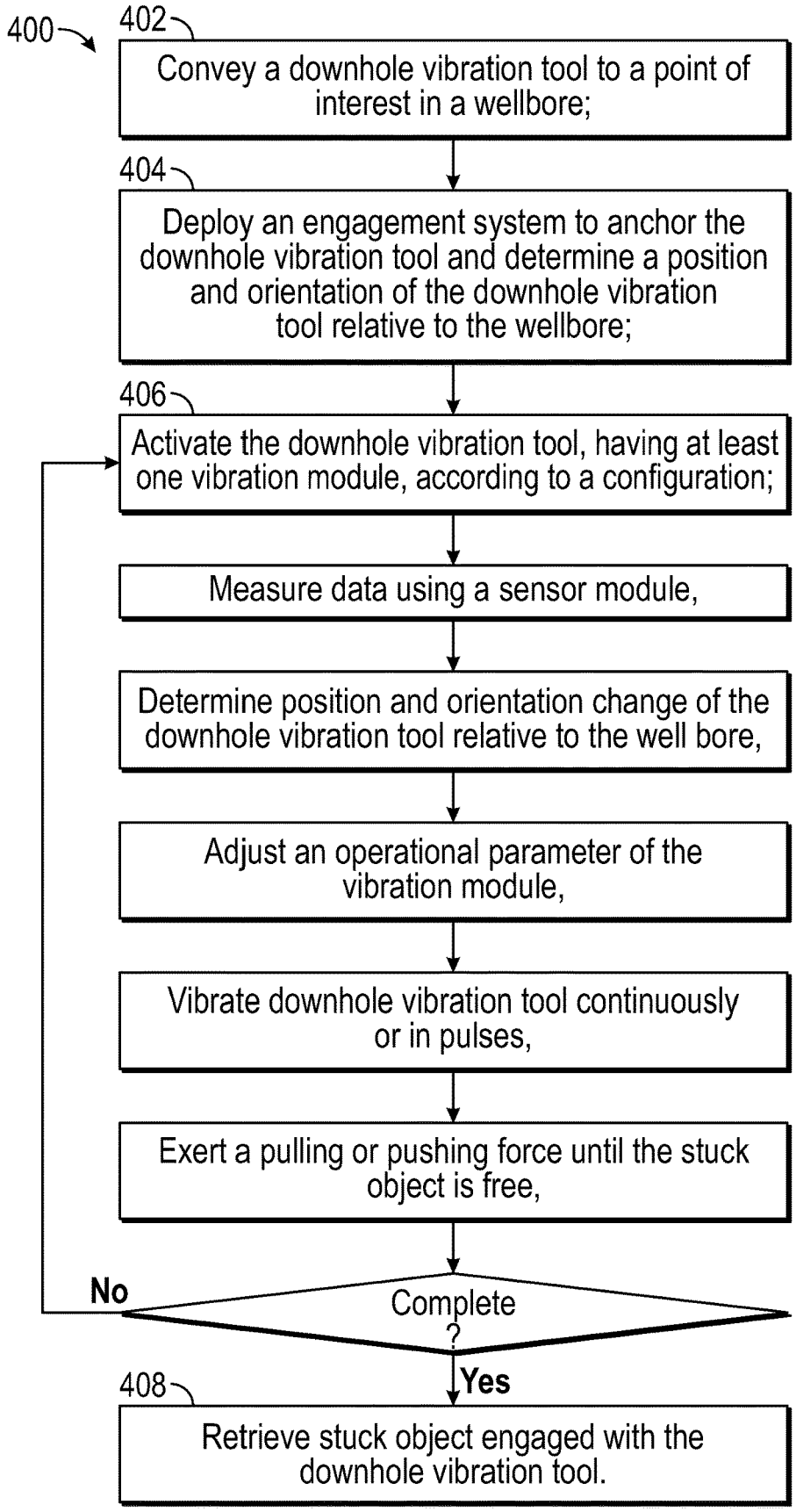
FIG. 4 shows a flowchart in accordance with one or more embodiments.

FIG. 4 provides a flowchart (400) describing a method of using the DVT (300) to retrieve a stuck object (204) from a wellbore (116) in accordance with one or more embodiments. In step 402 the DVT (300) may be conveyed into the wellbore (116). The DVT (300) is conveyed downhole to a point of interest. The point of interest may be determined based, at least in part, on the free end (208) of the stuck object or the depth to the sticking point (206). In one or more embodiments, the DVT (300) is conveyed using a wireline system. Alternatively, the DVT (300) head unit (302) may be configured to convey the tool on coil tubing or pipe.

In step 404, the engagement system (312) may be deployed to anchor the DVT (300) to the stuck object. Deploying the engagement system (312) may include anchoring the DVT (300) to the wellbore (116) using the or engaging the drone (322) with the stuck object (204). Once the engagement system (312) is fully deployed, the control system (308) using data from the sensor module (318) may be used to determine a position and orientation of the DVT (300) relative to the wellbore (116). In some embodiments, the engagement system (312) may be a fishing tool or a milling tool configured to attach to the leading tractor section (316) of the DVT (300). In one or more embodiments, the fishing tool or the milling tool may be connected to the DVT (300) using a drone (322). This type of engagement may be necessary when the hole diameter is small or when an internal type grappling method is not a viable option to engage the DVT (300) through an expanding type mechanism in the housing unit.

Step 406 is an iterative and repetitive step in which the DVT (300), having at least one vibration module, is activated according to a configuration. Due to the presence of the vibration dampener (320) and one or more vibrator modules (314) located at different locations within the DVT (300), multiple activation configurations may be performed. Thus, step 406 may also include adjusting the DVT (300) to a new configuration, if an initial configuration fails. For purposes of example only, one configuration may include only activating and vibrating the portion of the DVT (300) connected to the stuck object (204) through the drone (322). Another configuration may include only activating and vibrating the portion of the DVT (300) that is engaged with the wellbore (116). A further configuration may include activating and vibrating all portions of the DVT (300). Another configuration includes no vibration and only pushing and pulling the tool.

After activation of the DVT (300) is initiated, an assessment of the downhole conditions may be carried out based, at least in part, on data from the sensor module (318) such as strain, torque, weight. The operational parameters of the vibration modules (314) such as operating frequency, power, orientation, number, and position of the vibration modules (314) activated may be adjusted based, at least in part, on changes in the position and orientation of the DVT (300)

relative to the wellbore (116) or other sensor data. While these adjustments are taking place, the pulling or pushing force exerted by the conveyance (which may include the tractor section) is also monitored and adjusted. The iterative process continues, each time selecting a different configuration, until the stuck object (204) is free, as may be indicated by the pulling or pushing force mechanism and/or the sensor modules (318).

Step 408 is to retrieve the stuck object (204) engaged with the DVT (300) once the stuck object (204) is free.

Figure 5:
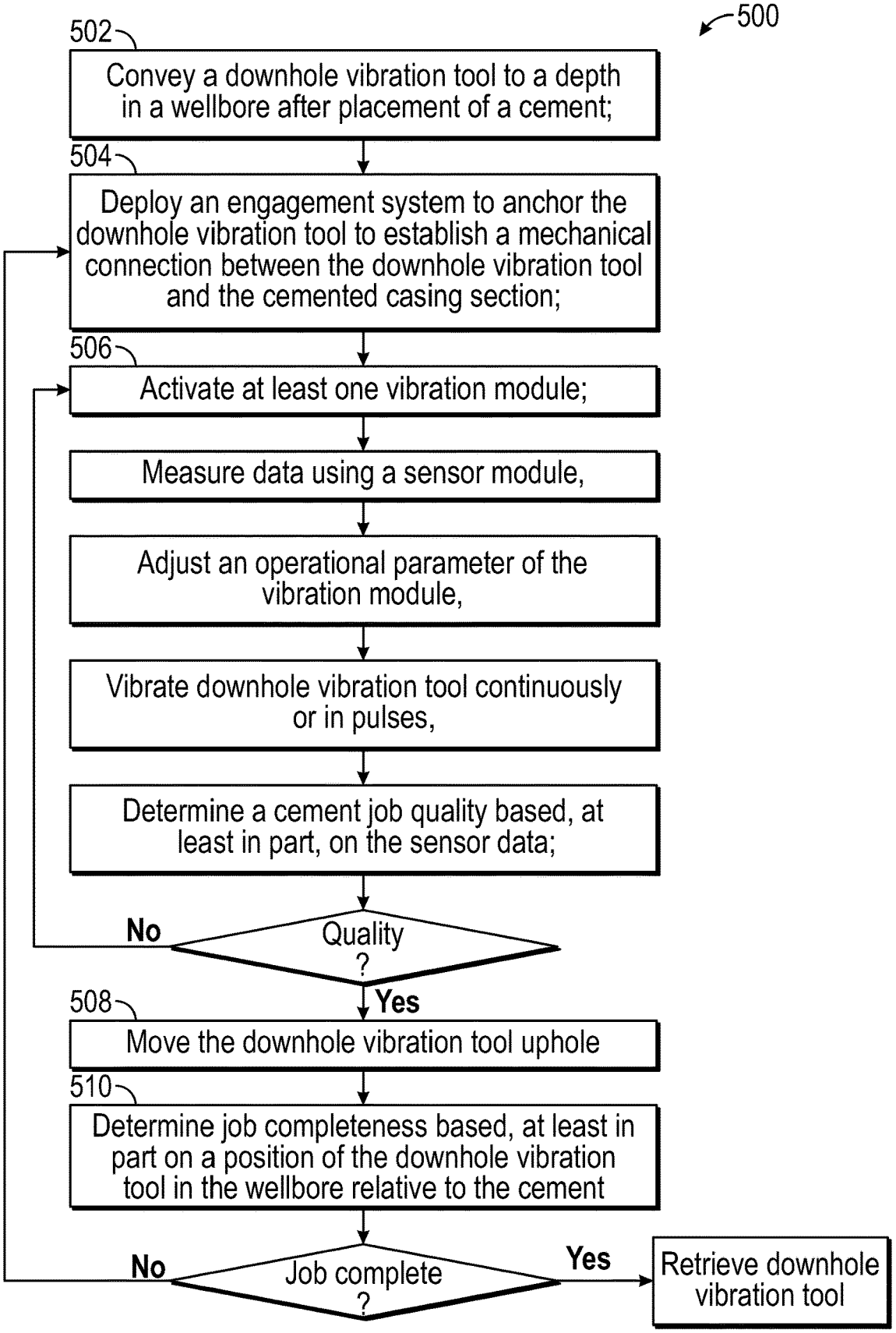
FIG. 5 shows a flow chart in accordance with one or more embodiments.

FIG. 5 shows a flowchart (500) in accordance with one or more embodiments, describing a method to use the DVT (300) in a cementation process. After cement is placed in the wellbore (116), in Step 502 the DVT (300) is conveyed into a wellbore (116) until it reaches a depth in the wellbore (116). In accordance with one or more embodiments, the DVT (300) is conveyed into the wellbore (116) as close to a cement shoe as possible, the Generally, the wellbore (116) will be filled with a displacement fluid such as water. If the displacement fluid is not compatible with wireline operations, the displacement fluid may need to be exchanged or the DVT (300) may need to be run on an alternative conveyance device (303) such as coiled tubing or pipe. In one or more embodiments, the DVT (300) may be used in conjunction with a wiper tool on one or more tips into the wellbore (116). Once the hole is suitable, in Step 504 the engagement system (312) is deployed to establish a mechanical connection between the DVT (300) and the casing behind which cement has been placed.

Step 506 is an iterative and repetitive process in which at least one vibration module (314) is activated and sensor data is measured from the sensor module (318). Using the sensor module 318) data, such as vibration frequency and vibration amplitude, operational parameters may be adjusted in one or more vibration modules (314). As the vibration is continued, the sensor module (318) data may be used to determine a cement job quality. The cement job quality may be a quantitative measure that qualitatively describes the cement job quality. The processes in Step 506 are repeated until a pre-determined cement job quality is reached. In Step 508 the DVT (300) is moved up hole. The DVT (300) may be moved up hole without vibration or under continuous vibration without departing from the scope of the disclosure herein. At the new up hole location, Step 510 the job completeness may be determined based, at least in part, on the position of the DVT (300) relative to the cement. If the DVT (300) has not reached the top of the cement, the process is restarted at Step 504 and repeated. If the job is determined to be complete, the DVT (300) may be retrieved from the wellbore (116).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A downhole vibration tool, comprising:

a head unit configured to attach to a conveyance system in a wellbore;

a housing configured to receive the head unit and house the downhole vibration tool components;

a power system disposed within the housing;

a control system disposed within the housing;

a first vibration module and a second vibration module disposed within the housing;

a first engagement system comprising first engagement arms disposed within the housing proximate the first vibration module and a second engagement system comprising second engagement arms disposed within the housing proximate the second vibration module;

an electric motor coupled to the first engagement system and the second engagement system, wherein the electric motor is configured to extend the first engagement arms or the second engagement arms from the housing to contact the wellbore;

a vibration dampener dividing the first vibration module and the first engagement system from the second vibration module and the second engagement system from one another in order to engage and vibrate the wellbore at two separate locations independently from one another; and at least one tractor section.

2. The downhole vibration tool of claim 1, further comprising at least one vibration module disposed within at least one tractor section.

3. The downhole vibration tool of claim 1, further comprising a sensor module comprising a plurality of sensors configured to record and transmit a plurality of sensor data to the control system wherein the plurality of sensors comprise at least one accelerometer and at least one gyroscopic sensor configured to determine an orientation of the tool relative to the wellbore.

4. The downhole vibration tool of claim 1, wherein at least one vibration module is configured to selectively induce an oriented vibration based, at least in part, on the orientation of the tool relative to the wellbore.

5. The downhole vibration tool of claim 1, wherein the vibration module performs over a broad frequency range based, at least in part on a displacement and a stress determined with data from at least one accelerometer, at least one gyroscopic sensor, and other sensor data.

6. The downhole vibration tool of claim 1, further comprising a fishing attachment optionally attached to a lead tractor section.

* * * * *